US008278847B2

(12) United States Patent
Chen et al.

(10) Patent No.: US 8,278,847 B2
(45) Date of Patent: Oct. 2, 2012

(54) LED MIXTURE CONTROL DEVICE AND CONTROLLING METHOD THEREOF

(75) Inventors: Po-Yen Chen, Taipei (TW); Ching-Ran Lee, Jinming Township, Kinmen County (TW); Li-Ling Lee, Cyonglin Township, Hsinchu County (TW); Ching-Tsai Pan, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 366 days.

(21) Appl. No.: 12/787,609

(22) Filed: May 26, 2010

(65) Prior Publication Data

US 2011/0121762 A1 May 26, 2011

(30) Foreign Application Priority Data

Nov. 23, 2009 (TW) ..... 98139835 A

(51) Int. Cl.
*H05B 37/02* (2006.01)

(52) U.S. Cl. ..... 315/312; 315/308; 315/297

(58) Field of Classification Search ..... 315/291, 315/294, 297, 307–312
See application file for complete search history.

(56) References Cited

U.S. PATENT DOCUMENTS

| | | | | |
|---|---|---|---|---|
| 7,122,842 | B2 * | 10/2006 | Hill | 257/86 |
| 8,174,205 | B2 * | 5/2012 | Myers et al. | 315/291 |
| 2010/0002440 | A1 * | 1/2010 | Negley et al. | 362/249.14 |
| 2010/0177280 | A1 * | 7/2010 | Buczek et al. | 351/221 |
| 2011/0285292 | A1 * | 11/2011 | Mollnow et al. | 315/113 |
| 2012/0133301 | A1 * | 5/2012 | Kerr et al. | 315/297 |

* cited by examiner

*Primary Examiner* — Don Le
(74) *Attorney, Agent, or Firm* — Thomas|Kayden

(57) ABSTRACT

A light source mixture control device for controlling a light source emitting different spectrums is provided. A coordination conversion unit receives and converts a hue signal and a luminance signal into a first to a third undecoupled color light component. A first color light component decoupling control unit decouples a first color light component from the first to the third undecoupled color light component. A second color light component decoupling control unit decouples the first undecoupled color light component into a first decoupled color light component. A third color light component decoupling control unit decouples the second undecoupled color light component into a second decoupled color light component. A fourth color light component decoupling control unit decouples the third undecoupled color light component into a third decoupled color light component. The first to the third decoupled color light component respectively control the light source.

13 Claims, 3 Drawing Sheets

LED MIXTURE CONTROL DEVICE AND CONTROLLING METHOD THEREOF

This application claims the benefit of Taiwan application Serial No. 98139835, filed Nov. 23, 2009, the subject matter of which is incorporated herein by reference.

TECHNICAL FIELD

The disclosure relates in general to a light emitting diode (LED) mixture control device and a method thereof.

BACKGROUND

LED has many advantages such as lightweight, low driving voltage, long lifespan, fast response, environmental friendliness, high color saturation and short driving time, and is viewed as a new light source with great potential in energy saving.

The LED light source can be divided into white-light LED light source and RGB LED light sources. By using the color-filterless technology, the three color lights emitted by the RGB LED are mixed in time domain mixture into white light. The white-light LED has lower cost, but the RGB LED has superior color characteristics.

Currently, LED has many implementations in dimming control and can be used in decoration illumination such as illumination control (control of the brightness and the colors), security system and smart homes.

In the past, prior to the LED illumination control, the color control database must be analyzed and constructed first to achieve accurate color control. However, if more combinations of light mixing are desired, a large volume of measurements must be performed in advance. Moreover, if the LED dies are to be replaced, the above process must be repeated.

BRIEF SUMMARY

Accordingly, the disclosure is directed to an LED mixture control device and a method thereof. The hue or the luminance of the mixed light is independently controlled. That is, the hue is controlled while the luminance is maintained, or the luminance of a hue is adjusted individually.

In one example of the disclosure, an LED mixture control device and a method thereof are provided. The hue and the luminance are used as input commands, wherein the RGB component and the white-light component are split by a decoupling control unit.

In another example of the disclosure, an LED mixture control device and a method thereof are provided. The hue and the luminance are used as input commands which independently control the red-light LED, the white-light LED and the blue-light LED.

In another example of the disclosure, an LED mixture control device and a method thereof are provided. The hue and the luminance are used as input commands which independently control the white-light LED.

In further another example of the disclosure, a light source mixture control device for controlling a light source emitting different spectrums are provided to independently control the hue and the luminance. The light source mixture control device includes a coordination conversion unit for receiving and converting a hue signal and a luminance signal into a first to a third undecoupled color light component. A first color light component decoupling control unit, coupled to the coordination conversion unit, decouples a first color light component from the first to the third undecoupled color light component. A second color light component decoupling control unit, coupled to the coordination conversion unit and the first color light component decoupling control unit, decouples the first undecoupled color light component into a first decoupled color light component according to the first color light component. A third color light component decoupling control unit, coupled to the coordination conversion unit and the first color light component decoupling control unit, decouples the second undecoupled color light component into a second decoupled color light component according to the first color light component. A fourth color light component decoupling control unit, coupled to the coordination conversion unit and the first color light component decoupling control unit, decouples the third undecoupled color light component into a third decoupled color light component according to the first color light component. The first to the third decoupled color light component respectively and independently control the light source.

In yet another example of the disclosure, a light source mixture control method for controlling a light source emitting different spectrums is provided to independently control the hue and the luminance. The light source mixture control method includes the following steps. A hue signal and a luminance signal are split into a first to a third undecoupled color light component. A first color light component is decoupled from the first to the third undecoupled color light component. A first undecoupled color light component is decoupled into a first decoupled color light component according to the first color light component. A second undecoupled color light component is decoupled into a second decoupled color light component according to the first color light component. A third undecoupled color light component is decoupled into a third decoupled color light component according to the first color light component. The first to the third decoupled color light component respectively and independently control the light source.

It is to be understood that both the foregoing general description and the following detailed description are exemplary and explanatory only and are not restrictive of the disclosed embodiments, as claimed.

BRIEF DESCRIPTION OF THE DRAWINGS

The disclosure can be more fully understand by reading the subsequent detailed description and examples with references made to the accompanying drawings, wherein.

DETAILED DESCRIPTION

Figure 1:
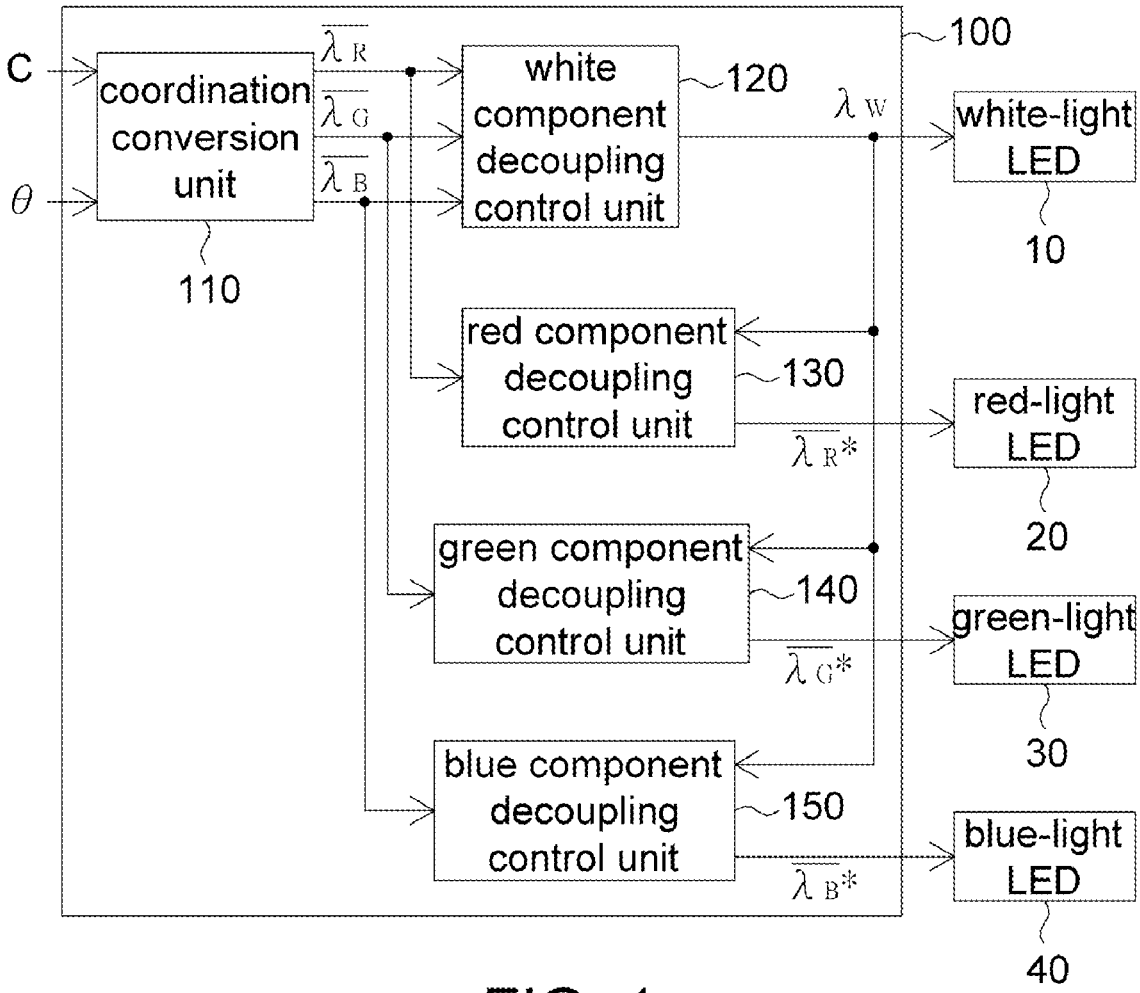
FIG. 1 is a schematic perspective view of a functional block diagram of an LED mixture control device according to an embodiment of the disclosure.

In the following detailed description, for purpose of explanation, numerous specific details are set forth in order to provide a through understanding of the disclosed embodiments. It will be apparent, however, that one or more embodiments may be practiced without these specific details. In other instances, well-known structures and devices are schematically shown in order to simplify the drawing.

In an embodiment of the disclosure, LED module characteristics are constructed according to an HSV color model; and a hue and a luminance are separated/converted into RGB components through coordinate rotation-conversion. The RGB components respectively control corresponding RGB LEDs. In other embodiments, a white-light component is obtained through decoupling control and is further used to control a white-light LED.

FIG. 1 is a schematic perspective view of a functional block diagram of an LED mixture control device according to an embodiment of the disclosure. As indicated in FIG. 1, the LED mixture control device 100 at least includes: a coordination conversion unit 110, a white-light component decoupling control unit 120, a red-light component decoupling control unit 130, a green-light component decoupling control unit 140 and a blue-light component decoupling control unit 150.

From the point of view of energy, when color lights are mixed, the luminance of the mixed light is the addition result of each luminance of the color lights to be mixed. Thus, the luminance of the mixed color light must be brighter than the luminance of each color light to be mixed. Therefore, if the color lights with lower luminance is mixed, more colors can be formed after mixing. To the contrary, if the color lights with higher luminance are mixed, the mixed color lights will have higher luminance, but the color light with lower luminance cannot be formed by mixing high luminance color lights.

RGB will result in largest mixture gamut, that is, it is possible to obtain each color other than RGB by mixing RGB. RGB are independent, and cannot be centered at a particular region of visible spectrum. Moreover, any of the RGB colors cannot be formed by mixing the other two primary colors. The RGB lights are the primary color lights obtained by decomposing a white light, and are also the three main primary color lights for mixing color lights. Almost any natural color lights can be formed by mixing the RGB lights according to different proportions.

In FIG. 1, C and θ denote the hue (H) and the luminance (V), respectively. In the HSV color attribute model, a color is defined by three basic color attributes, namely, the hue (H), the saturation (S) and the luminance (V). The hue is the basic color attribute, that is, the name of a color such as red, yellow and so on. The hue is a value ranging between 0-360 (or a percentage ranging between 0-100%). The saturation refers to the purity of a color, and the higher the saturation, the purer the color, and vice versa. The saturation is a value ranging between 0-100%. The luminance is also a value ranging between 0-100%.

When two or more than two colors are mixed, a new color will be generated, and this process is called the "additive color mixing process". From the point of view of energy, the color mixture equation in the additive color mixing process is expressed as formulas (1):

$$C=\alpha\lambda_R\beta\lambda_G+\gamma\lambda_B \tag{1}$$

Wherein, C denotes the total luminance of the mixed color light, $\lambda_R$, $\lambda_G$ and $\lambda_B$ respectively denote RGB unit components, and α, β and γ respectively denote the RGB component coefficients.

When the additive color mixing process is employed for light mixture, the RGB component coefficients α, β and γ corresponding to the RGB unit components $\lambda_R$, $\lambda_G$ and $\lambda_B$ must be obtained. That is, each color has the RGB component coefficients α, β and γ.

Figure 2:
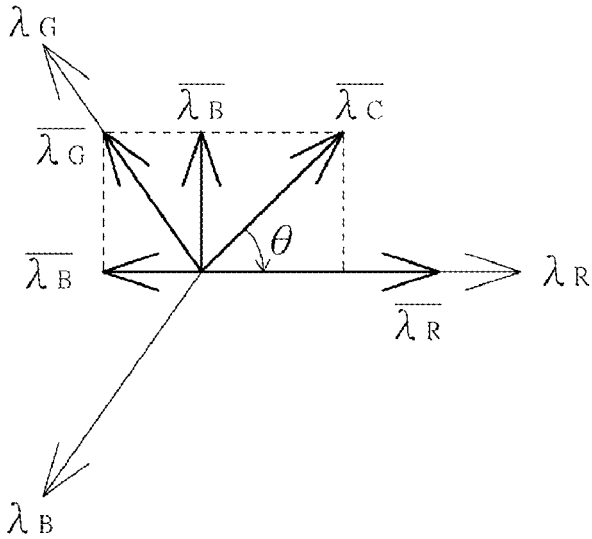
FIG. 2 is a schematic perspective view of a color vector space.

Referring to FIG. 2, a color vector space is shown. As indicated in FIG. 2, $\lambda_R$, $\lambda_G$ and $\lambda_B$ are defined as the RGB unit components in the color vector space. In the color vector space, the included angel between every two among RGB unit components $\lambda_R$, $\lambda_G$ and $\lambda_B$ is 120 degrees. Thus, the resultant vector of the three color components $\alpha\lambda_R$, $\beta\lambda_G$ and $\gamma\lambda_B$ is denoted in the form of $\lambda_c e^{j\theta}$. The three color components $\alpha\lambda_R$, $\beta\lambda_G$ and $\gamma\lambda_B$ are converted into two component (or two variables), namely, the luminance C and the hue θ, to reduce the number of the control variables in light mixture. The luminance C can be denoted by two component, namely, the white-light component $\lambda_w$ and the luminance of the hue $\lambda_c$ ($C=\lambda_w+\lambda_c$), wherein, $\lambda_c$ is also referred as saturation.

As the light is presented in the form of energy, the value is always positive. When the resultant vector of the three components $\alpha\lambda_R$, $\beta\lambda_G$ and $\gamma\lambda_B$ is denoted as $\lambda_c e^{j\theta}$, each of the color components needs to be shifted by ½ color component, so that each of the color components is positive. Thus, $\overline{\lambda_R}$, $\overline{\lambda_G}$ and $\overline{\lambda_B}$ are respectively denoted as:

$$\overline{\lambda_R} = \frac{1}{2}\alpha\lambda_R\cos\theta + \frac{1}{2}\alpha\lambda_R \tag{2}$$

$$\overline{\lambda_G} = \frac{1}{2}\beta\lambda_G\cos(\theta - 120) + \frac{1}{2}\beta\lambda_G \tag{3}$$

$$\overline{\lambda_B} = \frac{1}{2}\gamma\lambda_B\cos(\theta + 120) + \frac{1}{2}\gamma\lambda_B \tag{4}$$

Wherein, $\overline{\lambda_R}$, $\overline{\lambda_G}$ and $\overline{\lambda_B}$ are undecoupled RGB components respectively.

The white-light component $\lambda_w$ is denoted as:

$$\lambda_w=\min(\overline{\lambda_R},\overline{\lambda_G},\overline{\lambda_B}) \tag{5}$$

That is, the white-light component $\lambda_w$ is the minimum value among $\overline{\lambda_R}$, $\overline{\lambda_G}$ and $\overline{\lambda_B}$; and the white-light component $\lambda_w$ independently controls a white-light LED 10.

As the RGB components is shifted by ½ component, in each color light, each of the undecoupled RGB components $\overline{\lambda_R}$, $\overline{\lambda_G}$ and $\overline{\lambda_B}$ has the white-light component $\lambda_w$.

According to the white-light component $\lambda_w$, the red-light component decoupling control unit 130 decouples the undecoupled red-light component $\overline{\lambda_R}$ into the decoupled red-light component $\overline{\lambda_R}^*$: which independently controls the red-light LED 20. Likewise, according to the white-light component $\lambda_w$, the green-light component decoupling control unit 140 decouples the undecoupled green-light component $\overline{\lambda_G}$ into the decoupled green-light component $\overline{\lambda_G}^*$ which independently controls the white-light LED 30. According to the white-light component $\lambda_w$, the blue-light component decoupling control unit 150 decouples the undecoupled blue-light component $\overline{\lambda_B}$ into the decoupled blue-light component $\overline{\lambda_B}^*$ which independently controls the blue-light LED 40.

The white-light component varies $\lambda_w$ with the change of the hue θ, and accordingly, the color saturation $\lambda_c$ also varies with the change of the hue θ. In the present embodiment of the disclosure, to maintain the consistency of the color saturation $\lambda_w$ corresponding to the hue θ, the undecoupled RGB component needs to be decoupled.

The decoupling procedure performed by the red-light component decoupling control unit 130 is as follows.

When $\overline{\lambda_R}$ $\lambda_w$, $\overline{\lambda_R}^*$ is denoted as:

$$\overline{\lambda_R}^*=\overline{\lambda_R}+3/2\lambda_w \tag{6A}$$

When $\overline{\lambda_R}<\lambda_w$, $\overline{\lambda_R}^*$ is denoted as:

$$\overline{\lambda_R}^*=0 \tag{6B}$$

The decoupling procedure performed by the green-light component decoupling control unit 140 is as follows.

When $\overline{\lambda_G}\,\lambda_w$, $\overline{\lambda_G}^*$ is denoted as:

$$\overline{\lambda_G}^*=\overline{\lambda_G}+3/2\lambda_w \tag{7A}$$

When $\overline{\lambda_G}<\lambda_w$, $\overline{\lambda_G}^*$ is denoted as:

$$\overline{\lambda_G}^*=0 \tag{7B}$$

The decoupling procedure performed by the blue-light component decoupling control unit 150 is as follows.

When $\overline{\lambda_B}\,\lambda_w$, $\overline{\lambda_B}^*$ is denoted as:

$$\overline{\lambda_B}^*=\overline{\lambda_B}+3/2\lambda_w \tag{8A}$$

When $\overline{\lambda_B}<\lambda_w$, $\overline{\lambda_B}^*$ is denoted as:

$$\overline{\lambda_B}^*=0 \tag{8B}$$

Figure 3:
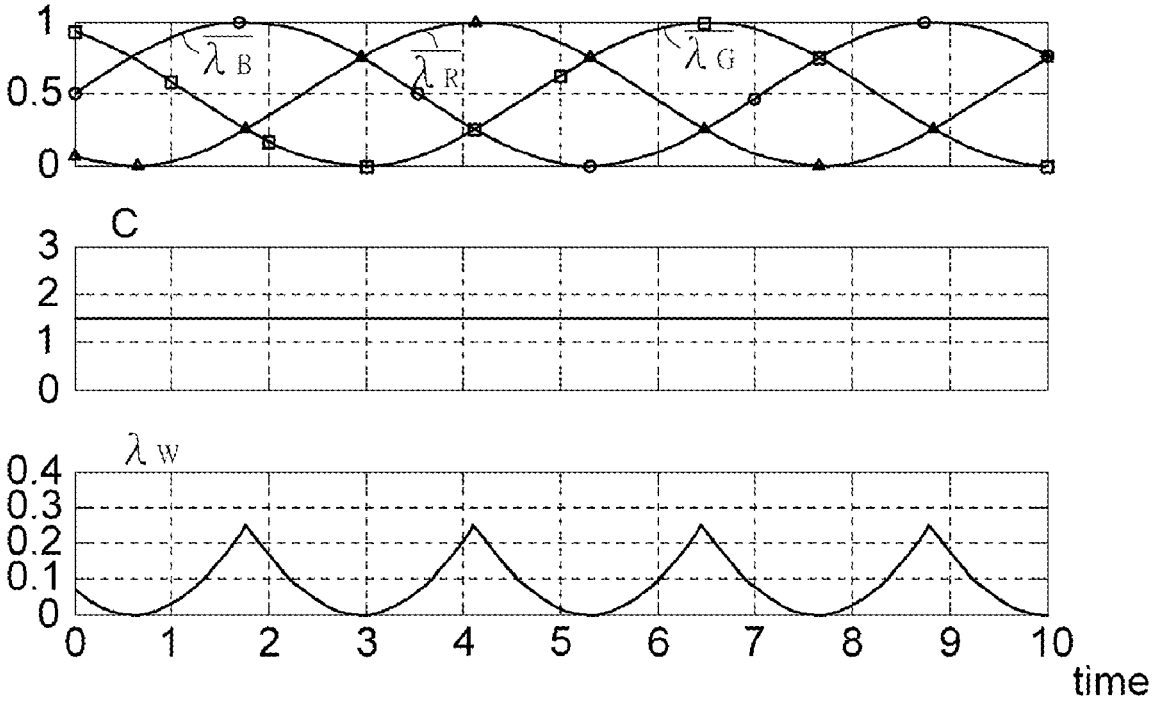
FIG. 3 is a schematic perspective view of an example of the undecoupled RGB components $\overline{\lambda_R}$, $\overline{\lambda_G}$ and $\overline{\lambda_B}$, the luminance C and the white-light component $\lambda_w$.
Figure 4:
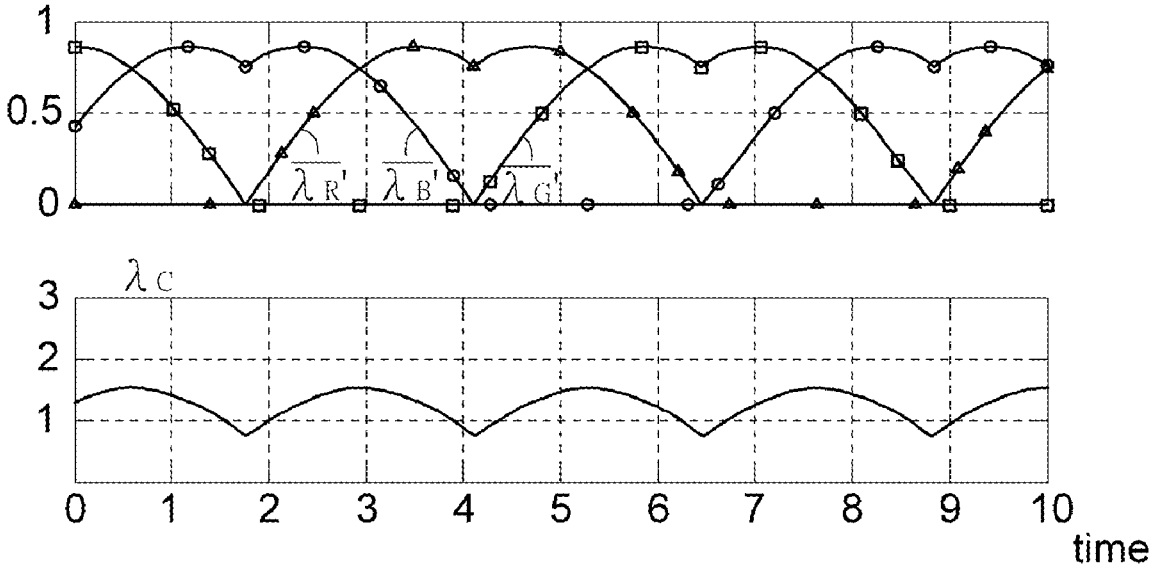
FIG. 4 is a schematic perspective view of the RGB components $\overline{\lambda_{R'}}$, $\overline{\lambda_{G'}}$ and $\overline{\lambda_{B'}}$ (whose white-light component $\lambda_w$ is removed) and the color saturation $\lambda_c$.

An example of the undecoupled RGB components $\overline{\lambda_R}$, $\overline{\lambda_G}$ and $\overline{\lambda_B}$, the luminance C and the white-light component $\lambda_w$ is illustrated in FIG. 3. The RGB component $\overline{\lambda_{R'}}$, $\overline{\lambda_{G'}}$ and $\overline{\lambda_{B'}}$ (whose white-light component $\lambda_w$ is removed) and the color saturation $\lambda_c$ are illustrated in FIG. 4. The RGB component $\overline{\lambda_{R''}}$, $\overline{\lambda_{G''}}$ and $\overline{\lambda_{B''}}$, whose white-light component $\lambda_w$ is removed, occur inside the decoupling control units 130~150 and thus are not illustrated in the drawing.

As each of the undecoupled RGB components $\overline{\lambda_R}$, $\overline{\lambda_G}$ and $\overline{\lambda_B}$ has the white-light component $\lambda_w$, the white-light component $\lambda_w$ can be viewed as a compensation value for the color saturation $\lambda_c$. In the present embodiment of the disclosure, $$\frac{3}{2}\lambda_w$$

is added to one or two larger component among the undecoupled RGB components $\overline{\lambda_R}$, $\overline{\lambda_G}$ and $\overline{\lambda_B}$. As indicated in the above formulas, $$\frac{3}{2}\lambda_w$$

is added to the one or two components larger than $\lambda_w$.

Figure 5:
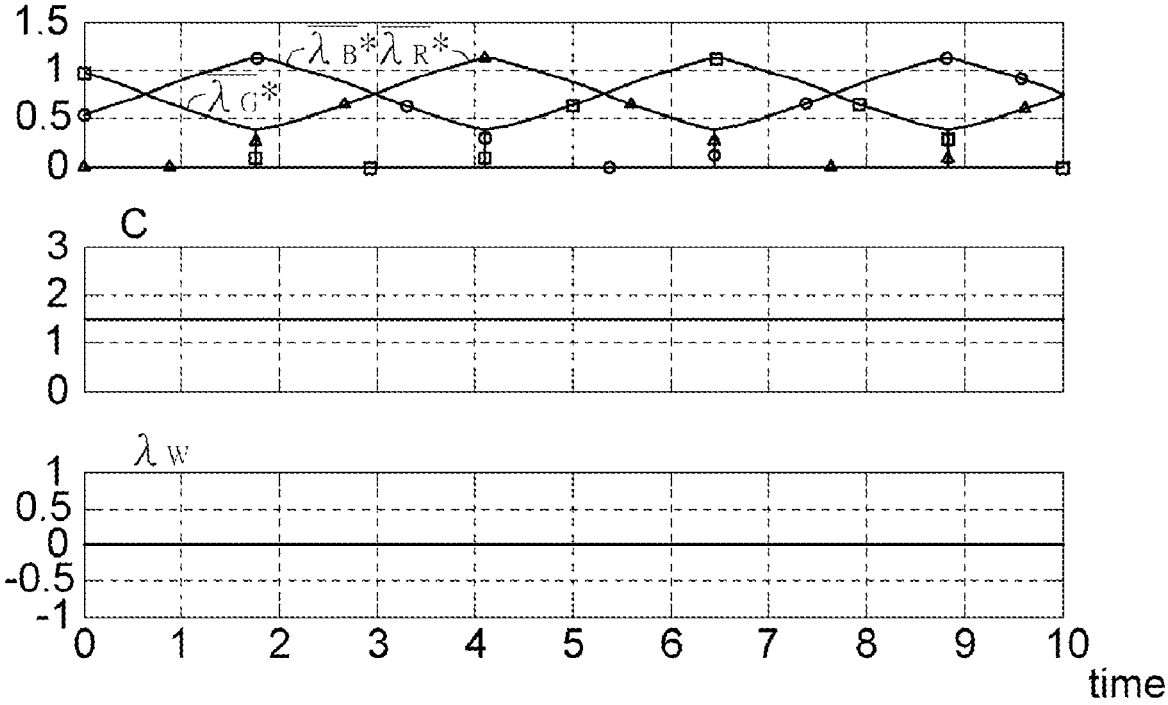
FIG. 5 is a schematic perspective view of the decoupled RGB components $\overline{\lambda_R}^*$, $\overline{\lambda_G}^*$, and $\overline{\lambda_B}^*$, the luminance C and the white-light component $\lambda_w$.

In the present embodiment of the disclosure, without changing the luminance C and the saturation $\lambda_c$, color of the mixture light is changed by changing the hue θ. On the other hand, in the present embodiment of the disclosure, the luminance is changed while the color of the mixture light is maintained. The decoupled RGB components $\overline{\lambda_R}^*$, $\overline{\lambda_G}^*$ and $\overline{\lambda_B}^*$ and the luminance C and the white-light component $\lambda_w$ are shown in FIG. 5. As indicated in FIG. 5, the white-light component $\lambda_w$ in the RGB primary lights is 0 after decoupling.

In the present embodiment of the disclosure, the hue and the luminance are used as input commands into a decoupling control unit, for splitting into the RGB component and the white-light component. Besides, the hue and the luminance are used as input commands to independently control the red-light LED, the white-light LED and the blue-light LED. Moreover, the hue and the luminance are used as input commands to independently control the white-light LED. Further, the hue or the luminance of the mixed LED light can be independently controlled. That is, the hue is controlled/changed while the luminance is maintained, or the luminance of a hue is adjusted individually.

It will be appreciated by those skilled in the art that changes could be made to the disclosed embodiments described above without departing from the broad inventive concept thereof. It is understood, therefore, that the disclosed embodiments are not limited to the particular examples disclosed, but is intended to cover modifications within the spirit and scope of the disclosed embodiments as defined by the claims that follow.

What is claimed is:

1. A light source mixture control device for controlling a light source emitting different spectrums to independently control a hue and a luminance, the light source mixture control device comprising:

a coordination conversion unit for receiving and converting a hue signal and a luminance signal into a first, a second and a third undecoupled color light component;

a first color light component decoupling control unit, coupled to the coordination conversion unit, for decoupling a first color light component from the first to the third undecoupled color light component;

a second color light component decoupling control unit, coupled to the coordination conversion unit and the first color light component decoupling control unit, for decoupling the first undecoupled color light component into a first decoupled color light component according to the first color light component;

a third color light component decoupling control unit, coupled to the coordination conversion unit and the first color light component decoupling control unit, for decoupling the second undecoupled color light component into a second decoupled color light component according to the first color light component; and a fourth color light component decoupling control unit, coupled to the coordination conversion unit and the first color light component decoupling control unit, for decoupling the third undecoupled color light component into a third decoupled color light component according to the first color light component, wherein the first to the third decoupled color light component respectively and independently control the light source.

2. The light source mixture control device according to claim 1, wherein, the first color light component decoupling control unit selects a minimum value among the first to the third undecoupled color light component as the first color light component.

3. The light source mixture control device according to claim 1, wherein:

the first color light component independently controls the white-light light emitting diode (LED) of the light source;

the first decoupled color light component independently controls the red-light LED of the light source;

the second decoupled color light component independently controls the green-light LED of the light source; and the third decoupled color light component independently controls the blue-light LED of the light source.

4. The light source mixture control device according to claim 1, wherein, a decoupling procedure performed by the second color light component decoupling control unit is as follows:

when $\overline{\lambda_R}\,\lambda_w$, $\overline{\lambda_R}^*$ is denoted as $$\overline{\lambda_R^*}=\overline{\lambda_R}+\frac{3}{2}\lambda_w;$$

and when $\overline{\lambda_R}<\lambda_w$, $\overline{\lambda_R}^*$ is denoted as $\overline{\lambda_R}^*=0$;

wherein, $\overline{\lambda_R}$, $\lambda_w$ and $\overline{\lambda_R}^*$ denote the first undecoupled color light component, the first color light component and the first decoupled color light component respectively.

5. The light source mixture control device according to claim 1, wherein, a decoupling procedure performed by the third color light component decoupling control unit is as follows:

when $\overline{\lambda_G}$ $\lambda_w$, $\overline{\lambda_G}^*$ is denoted as $$\overline{\lambda_G^*} = \overline{\lambda_G} + \frac{3}{2}\lambda_w;$$

and when $\overline{\lambda_G}<\lambda_w$, $\overline{\lambda_G}^*$ is denoted as $\overline{\lambda_G}^*=0$, wherein, $\overline{\lambda_G}$, $\lambda_w$ and $\overline{\lambda_G}^*$ denote the second undecoupled color light component, the first color light component and the second decoupled color light component respectively.

6. The light source mixture control device according to claim 1, wherein, a decoupling procedure performed by the fourth color light component decoupling control unit is as follows:

when $\overline{\lambda_B}$ $\lambda_w$, $\overline{\lambda_B}^*$ is denoted as $$\overline{\lambda_B^*} = \overline{\lambda_B} + \frac{3}{2}\lambda_w;$$

and when $\overline{\lambda_B}<\lambda_w$, $\overline{\lambda_B}^*$ is denoted as $\overline{\lambda_B}^*=0$;

wherein, $\overline{\lambda_B}$, $\lambda_w$ and $\overline{\lambda_B}^*$ denote the third undecoupled color light component, the first color light component and the third decoupled color light component respectively.

7. A light source mixture control method for controlling a light source emitting different spectrums to independently control a hue and a luminance, the light source mixture control method comprising:

splitting a hue signal and a luminance signal into a first to a third undecoupled color light component;

decoupling a first color light component from the first to the third undecoupled color light component;

decoupling the first undecoupled color light component into a first decoupled color light component according to the first color light component;

decoupling the second undecoupled color light component into a second decoupled color light component according to the first color light component;

decoupling the third undecoupled color light component into a third decoupled color light component according to the first color light component; and respectively and independently controlling the light source by the first to the third decoupled color light component.

8. The light source mixture control method according to claim 7, wherein, the step of splitting the hue signal and the luminance signal into the first to the third undecoupled color light component comprises:

splitting the hue signal and the luminance signal into the first to the third undecoupled color light component by coordinate conversion.

9. The light source mixture control method according to claim 7, wherein, the step of decoupling the first color light component from the first to the third undecoupled color light component comprises:

selecting a minimum value among the first to the third undecoupled color light component as the first color light component.

10. The light source mixture control method according to claim 7, wherein:

the first color light component which independently controls the white-light light emitting diode (LED) of the light source;

the first decoupled color light component independently controls the red-light LED of the light source;

the second decoupled color light component independently control the green-light LED of the light source; and the third decoupled color light component independently controls the blue-light LED of the light source.

11. The light source mixture control method according to claim 7, wherein, the step of decoupling the first undecoupled color light component into the first decoupled color light component according to the first color light component comprises:

when $\overline{\lambda_R}$ $\lambda_w$, $\overline{\lambda_R}^*$ is denoted as $$\overline{\lambda_R^*} = \overline{\lambda_R} + \frac{3}{2}\lambda_w;$$

and when $\overline{\lambda_R}<\lambda_w$, $\overline{\lambda_R}^*$ is denoted as $\overline{\lambda_R}^*=0$;

wherein, $\overline{\lambda_R}$, $\lambda_w$ and $\overline{\lambda_R}^*$ denote the first undecoupled color light component, the first color light component and the first decoupled color light component respectively.

12. The light source mixture control method according to claim 7, wherein, the step of decoupling the second undecoupled color light component into the second decoupled color light component according to the first color light component comprises:

when $\overline{\lambda_G}$ $\lambda_w$, $\overline{\lambda_G}^*$ is denoted as $$\overline{\lambda_G^*} = \overline{\lambda_G} + \frac{3}{2}\lambda_w;$$

and when $\overline{\lambda_G}<\lambda_w$, $\overline{\lambda_G}^*$ is denoted as $\overline{\lambda_G}^*=0$;

wherein, $\overline{\lambda_G}$, $\lambda_w$ and $\overline{\lambda_G}^*$ denote the second undecoupled color light component, the first color light component and the second decoupled color light component respectively.

13. The light source mixture control method according to claim 7, wherein, the step of decoupling the third undecoupled color light component into the third decoupled color light component according to the first color light component comprises:

when $\overline{\lambda_B}$ $\lambda_w$, $\overline{\lambda_B}^*$ is denoted as $$\overline{\lambda_B^*} = \overline{\lambda_B} + \frac{3}{2}\lambda_w;$$

and when $\overline{\lambda_B}<\lambda_w$, $\overline{\lambda_B}^*$ is denoted $\overline{\lambda_B}^*B=0$;

wherein, $\overline{\lambda_B}$, $\lambda_w$ and $\overline{\lambda_B}^*$ denote the third undecoupled color light component, the first color light component and the third decoupled color light component respectively.

* * * * *